US010837214B2

(12) United States Patent
Kim et al.

(10) Patent No.: US 10,837,214 B2
(45) Date of Patent: Nov. 17, 2020

(54) REFRIGERATOR

(71) Applicant: LG ELECTRONICS INC., Seoul (KR)

(72) Inventors: Hyunbum Kim, Seoul (KR); Dongjeong Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 15/798,637

(22) Filed: Oct. 31, 2017

(65) Prior Publication Data

US 2018/0119475 A1 May 3, 2018

(30) Foreign Application Priority Data

Nov. 3, 2016 (KR) ..... 10-2016-0145996

(51) Int. Cl.
*E05F 15/614* (2015.01)
*E05F 15/619* (2015.01)
*F25D 23/02* (2006.01)

(52) U.S. Cl.
CPC ..... *E05F 15/614* (2015.01); *E05F 15/619* (2015.01); *F25D 23/028* (2013.01); *E05Y 2201/618* (2013.01); *E05Y 2201/716* (2013.01); *E05Y 2201/722* (2013.01); *E05Y 2400/85* (2013.01); *E05Y 2800/122* (2013.01); *E05Y 2900/31* (2013.01)

(58) Field of Classification Search
CPC ..... F25D 23/028; F25D 23/02; E05F 15/614
USPC ..... 312/401, 405, 319.5, 319.7
See application file for complete search history.

(56) References Cited

U.S. PATENT DOCUMENTS 6,338,536 B1 * 1/2002 Ueno ..... E05B 17/0033 312/405
8,454,102 B2 * 6/2013 Kim ..... E05F 15/619 312/319.5
8,653,767 B2 * 2/2014 Kim ..... G05B 19/042 312/319.7
2010/0018122 A1 1/2010 Hecht et al.
2010/0141107 A1 * 6/2010 Kim ..... F25D 23/028 312/405

(Continued)

FOREIGN PATENT DOCUMENTS

CN 101634512 1/2010
EP 3086064 10/2016

(Continued)

OTHER PUBLICATIONS

Chinese Office Action in Chinese Application No. 201780068175.8, dated Jul. 3, 2020, 23 pages (with English translation).

*Primary Examiner* — James O Hansen
(74) *Attorney, Agent, or Firm* — Fish & Richardson P.C.

(57) ABSTRACT

A refrigerator includes a cabinet, a door, and a door opening device. The door opening device includes a motor and a pushing member configured to be withdrawn out by the motor to open the door. The pushing member includes a first rack configured to be driven by the motor and to push one of the cabinet or the door, and a second rack configured to be driven by the motor and slidably coupled to the first rack in which the second rack at least partially overlaps with the first rack. The first rack is configured to move relative to the second rack in a first direction to open the door to a first angle, and to move together with the second rack in the first direction to move the door to a second angle greater than the first angle.

18 Claims, 14 Drawing Sheets

(56) References Cited

U.S. PATENT DOCUMENTS

| | | | | |
|---|---|---|---|---|
| 2011/0048060 | A1* | 3/2011 | Kim | E05B 17/0029 62/449 |
| 2016/0312516 | A1* | 10/2016 | Heydel | H02K 7/116 |

FOREIGN PATENT DOCUMENTS

| | | | |
|---|---|---|---|
| JP | 2000320955 | | 11/2000 |
| JP | 03519313 | A | 4/2004 |
| JP | 2005133994 | A | 5/2005 |
| KR | 2007111856 | A | 11/2007 |
| KR | 2010064022 | A | 6/2010 |
| KR | 2011024883 | A | 3/2011 |
| KR | 1151618 | A | 6/2012 |
| KR | 10-1618552 | * | 5/2016 |

* cited by examiner

REFRIGERATOR

CROSS-REFERENCE TO RELATED APPLICATIONS

This application claims priority under 35 U.S.C. § 119 to Korean Patent Application No. 10-2016-0145996, filed in Korea on Nov. 3, 2016, whose entire disclosure is hereby incorporated by reference.

FIELD

The present disclosure relates to a refrigerator.

BACKGROUND

A refrigerator is a home appliance that can keep objects such as food in a storage compartment provided in a cabinet at a low temperature. The storage compartment may be surrounded by an insulation wall such that the internal temperature of the storage compartment is maintained at a temperature lower than an external temperature. The storage compartment may be referred to as a refrigerating compartment or a freezing compartment according to the temperature range of the storage compartment.

A user may open and close the storage compartment using a door. The user opens the door in order to put objects into the storage compartment or take objects out of the storage compartment. In some examples, the door is rotatably provided on the cabinet and a gasket is provided between the door and the cabinet. In some cases, in a state of closing the door, the gasket may be closely adhered between the door and the cabinet to prevent leakage of cool air from the storage compartment. As adhesion force of the gasket increases, the effect of preventing leakage of cool air may increase.

In order to increase adhesion force of the gasket, the gasket may be formed of, for example, a rubber magnet or a magnet may be provided in the gasket. However, if adhesion force of the gasket increases, a large force may be required to open the door.

Recently, refrigerators having an auto closing function have been provided. For example, an auto closing function refers to a function for automatically closing the door of the refrigerator using adhesion force and magnetic force of the gasket and elastic force of a spring when the door of the refrigerator is slightly opened. In some examples, the auto closing function refers to a function for preventing the door of the refrigerator from being automatically opened even when the refrigerator is slightly tilted forward.

In some cases, recent refrigerators may require a large force to open a door as compared to refrigerators of the related art, because force larger than adhesion force and magnetic force of a gasket and elastic force of a spring is required to open the door of the refrigerator.

For example, a force of 6 kgf may be required for a user to open the door of the refrigerator. Since such force is relatively large, the door cannot be easily opened. When the door is opened by applying a very large force, the door may be rapidly opened.

A door opening device for enabling a rack to push a door to automatically open the door is provided.

Hereinafter, a door opening device of the related art will be described with reference to FIGS. 1 to 4.

FIG. 1 shows an example refrigerator applicable to the related art or an implementation of the present disclosure, and FIG. 2 shows an example door of the example refrigerator applicable to the related art or an implementation of the present disclosure.

A door opening device 25 is provided in a door and, for example, at the upper side of the door. The door opening device may be provided in a cap decoration part. Accordingly, it may be difficult to increase the front-and-rear length of the door opening device 25 to be greater than the front-and-rear length (thickness) of the door.

As shown in FIGS. 3 and 4, the door opening device 25 of the related art includes an example single rack 30 and the single rack is withdrawn and inserted by driving a motor 27.

FIG. 3 shows a state in which a rack 30 is inserted into a housing 26 of the door opening device 25 and FIG. 4 shows a state in which the rack is withdrawn.

Driving power of the motor 27 is transferred to the rack 30 through a power transferring device 28. Accordingly, the rack is withdrawn when the motor is driven in one direction and the rack is inserted when the motor is driven in the other direction.

In some examples, the power transferring device 28 may include a plurality of reduction gears 29 and rotation of the reduction gears 29 moves the rack 30. Accordingly, the rack 30 includes a rack body 31 and a rack gear 32 formed in the rack body. Driving power is transferred through engagement between the reduction gears 29 and the rack gear 32.

A rack cover 33 is provided on a distal end of the rack 30. The rack cover 33 contacts the cabinet of the refrigerator and thus may be formed of an elastic material. That is, as the rack 30 is withdrawn, the rack cover 33 pushes the cabinet, thereby opening the door.

The door opening device 25 is driven to automatically open the door. For example, the door may be automatically opened in a state in which the user does not apply force to open the door. Accordingly, the door may be conveniently opened in a state in which the user holds objects in both hands.

As can be seen from FIG. 4, the opening angle of the door is changed according to the withdrawal distance of the rack. For example, if a curved rack shown in FIG. 4 is used, the door may be automatically opened by about 25 degrees. In some examples, although the shape of the rack is linear, when the curved rack is used, the opening angle of the door is further reduced as compared to the case where the linear rack is used.

The door is automatically opened in order to take food out of the storage compartment or to put food into the storage compartment without manually opening the door. Accordingly, the door should be opened to provide a space sufficient for the user to access the storage compartment. For example, when the door is opened by about 25 degrees, the user may not satisfactorily use the refrigerator.

For example, when the door is automatically opened by about 25 degrees, the user may further open the door using the user's body or foot while the user may hold objects in both hands at the moment. In this case, an unsanitary problem may occur and automatically opening the door may cause an inconvenience to the user.

In some examples, it may be difficult to increase the withdrawal distance of the rack, because the length of the rack is limited by the thickness of the door. For example, there may be a limitation in increase in the length of the rack due to restriction in the internal space of the door of the refrigerator. Therefore, there may be a limitation in increase in the protrusion length of the rack.

SUMMARY

The present disclosure provides a refrigerator capable of changing the length of a rack for opening a door.

The present disclosure provides a refrigerator capable of overcoming limitation of a space where a rack for opening a door is mounted, by decreasing the length of the rack upon insertion and increasing the length of the rack upon withdrawal.

The present disclosure provides a refrigerator capable of easily increasing an opening angle of a door.

The present disclosure provides a refrigerator capable of changing the length of a rack by a mechanical mechanism upon driving a motor.

According to one aspect of the subject matter described in this application, a refrigerator includes a cabinet defining a storage compartment, a door configured to open and close the storage compartment, and a door opening device configured to open the door in which the door opening device includes a motor and a pushing member configured to be withdrawn out by the motor to thereby open the door. The pushing member includes a first rack configured to be driven by the motor and to push one of the cabinet or the door, and a second rack configured to be driven by the motor and slidably coupled to the first rack in which the second rack at least partially overlaps with the first rack. The first rack is configured to move relative to the second rack in a first direction to open the door to a first angle, and to move together with the second rack in the first direction to move the door to a second angle greater than the first angle.

Implementations according to this aspect may include one or more of following features. The door opening device may further include a connection gear configured to transfer power to the pushing member, and the connection gear may be configured to engagingly contact the first rack and the second rack. In some cases, a portion of the second rack that overlaps with the first rack may vary based on the first rack moving relative to the second rack. The connection gear may be configured, based on moving the first rack relative to the second rack, to engagingly contact the first rack without engagingly contacting the second rack. The connection gear may be configured, based on moving the first rack together with the second rack, to engagingly contact both the first rack and the second rack.

In some implementations, the connection gear may be configured, based on moving the first rack relative to the second rack, to engagingly contact the first rack without engagingly contacting the second rack. The connection gear may be configured, based on moving the first rack together with the second rack, to engagingly contact the second rack without engagingly contacting the second rack. The first rack may include a first rack gear configured to selectably engage with the connection gear, and the second rack may include a second rack gear configured to selectably engage with the connection gear. In some examples, the first rack gear may be arranged along a longitudinal direction of the first rack, and the second rack gear may be arranged at a rear portion of the second rack and configured to align with the first rack gear based on the first rack overlapping with the second rack.

In some implementations, the second rack gear may be located vertically below the first rack gear, and the connection gear may have a height that enables engagement with both of the first and second rack gears. The pushing member may be configured to open the door to the first angle based on the first rack being driven by the motor, and the pushing member may be configured to open the door to the second angle based on the second rack being driven by the motor. The first rack may be configured to move relative to the second rack based on the first rack being driven by the motor, and the first rack may be configured to move together with the second rack based on the second rack being driven by the motor.

In some implementations, the first rack may be configured to be withdrawn by a first predetermined distance relative to the second rack, the first rack may be configured to move together with the second rack based on the first rack being withdrawn by the first predetermined distance relative to the second rack, the second rack may be configured to be withdrawn by a second predetermined distance relative to the first rack based on the first rack moving together with the second rack, and the first rack may be configured to move together with the second rack based on the second rack being withdrawn by the second predetermined distance relative to the first rack. In some examples, the first rack may be configured to be withdrawn by a predetermined distance relative to the second rack, and the first rack may be configured to move together with the second rack based on the first rack being withdrawn by the predetermined distance relative to the second rack.

In some implementations, the door opening device may further include a coupling member configured to restrict relative movement between the first rack and the second rack based on the first rack being withdrawn by the predetermined distance relative to the second rack. The coupling member may include a first coupling member configured to restrict relative movement between the first rack and the second rack in the first direction, and a second coupling member configured to restrict relative movement between the first rack and the second rack in a second direction opposite the first direction.

According to another aspect, a refrigerator includes a cabinet defining a storage compartment, a door configured to open and close the storage compartment, and a door opening device configured to open the door in which the door opening device includes a motor and a pushing member configured to be withdrawn out by the motor to open the door. The pushing member includes a first rack configured to be withdrawn in a first direction, a second rack relative to which the first rack is configured to be withdrawn by a predetermined distance in the first direction, and a coupling member configured, based on the first rack being withdrawn by the predetermined distance relative to the second rack, to couple the first rack to the second rack to thereby restrict relative movement between the first rack and the second rack. The door opening device is configured to move the first rack relative to the second rack by engaging and driving the first rack to open the door to a first angle, and the door opening device is configured, based on the first rack being coupled to the second rack, to move the first rack and the second rack by engaging and driving the second rack to open the door to a second angle greater than the first angle.

Implementations according to this aspect may include one or more of following features. The door opening device may further include a connection gear configured to transfer power from the motor to the pushing member, the first rack may include a first rack gear configured to selectably engage with the connection gear, and the second rack may include a second rack gear configured to selectably engage with the connection gear. The first rack may be configured to be withdrawn by the predetermined distance relative to the second rack based on the first rack gear engaging with the connection gear, the first rack gear may be configured to disengage with the connection gear based on the first rack having been withdrawn by the predetermined distance, and the second rack gear may be configured to engage with the connection gear based on the first rack gear disengaging with the connection gear.

In some implementations, the first rack may be configured to be withdrawn to a final position to open the door to the second angle based on having moved together with the second rack. The first rack may be configured to retract from the final position together with the second rack in a second direction opposite the first direction based on the second rack gear being engaged with the connection gear. The first rack may be configured, based on the first rack having retracted together with the second rack in the second direction, to retract relative to the second rack in the second direction based on the first rack gear being engaged with the connection gear.

Figure 6:
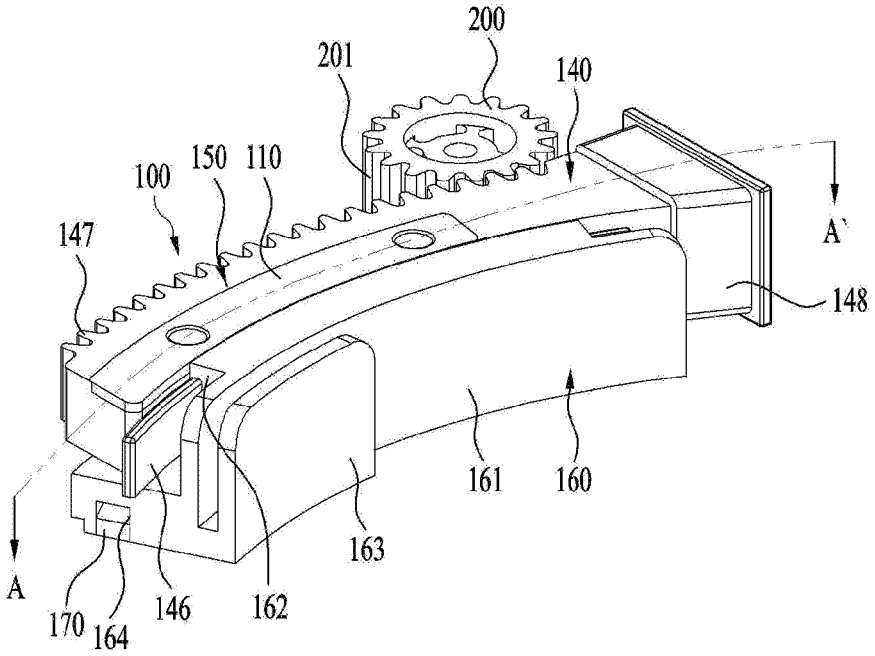
FIG. 6 is a view of another example multi-stage rack of another example door opening device.

9 is a cross-sectional view taken along line A-A' of FIG. 6 showing an example relative withdrawal of an example second rack.

Figure 10:
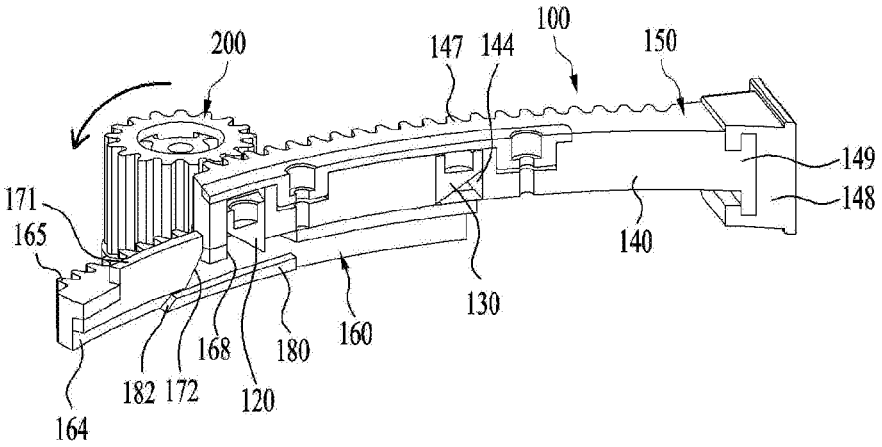

FIG. 10 is a cross-sectional view taken along line A-A' of FIG. 6 showing an example simultaneous withdrawal of a first rack in a cross-section.

Figure 11:
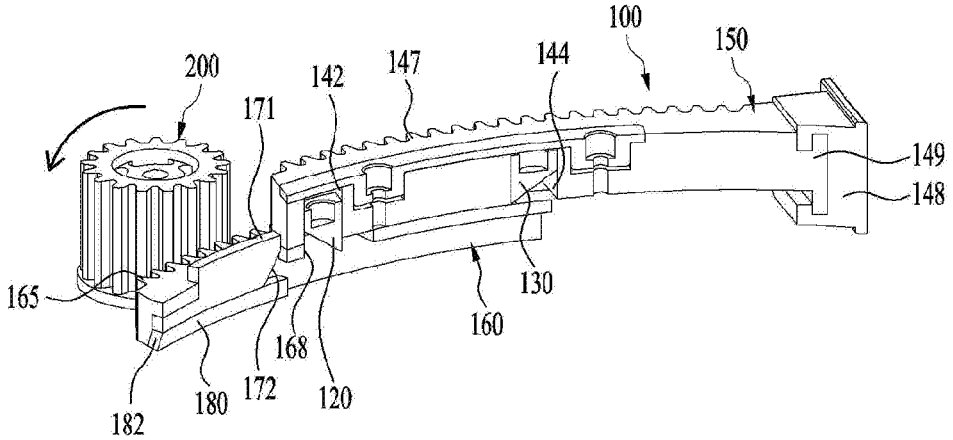

FIG. 11 is a cross-sectional view taken along line A-A' of FIG. 6 showing a state in which the multi-stage rack is maximally withdrawn.

Figure 12:
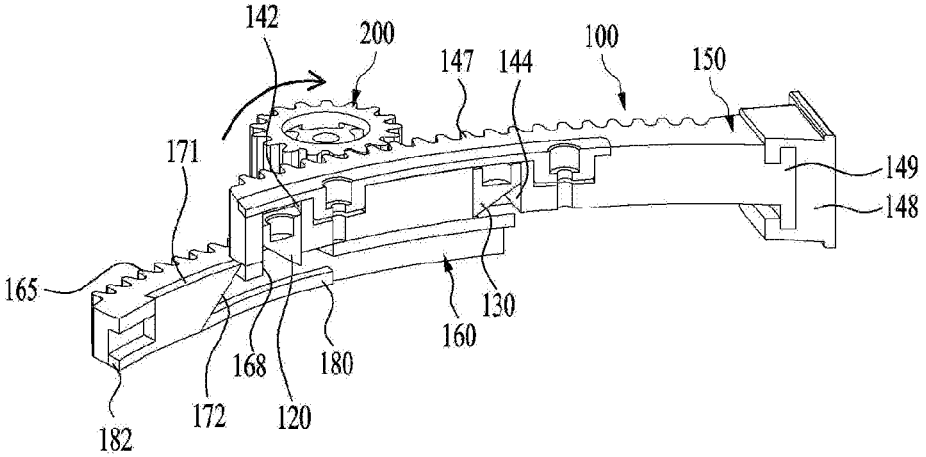

FIG. 12 is a cross-sectional view taken along line A-A' of FIG. 6 showing an example relative insertion of the first rack.

Figure 13:
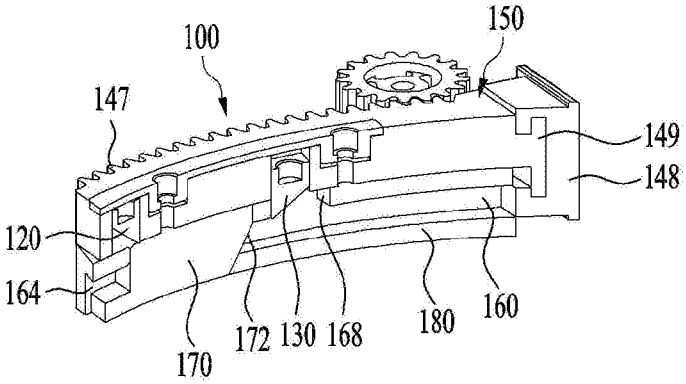

FIG. 13 is a cross-sectional view taken along line A-A' of FIG. 6 showing an example simultaneous insertion of the first rack.

Figure 14:
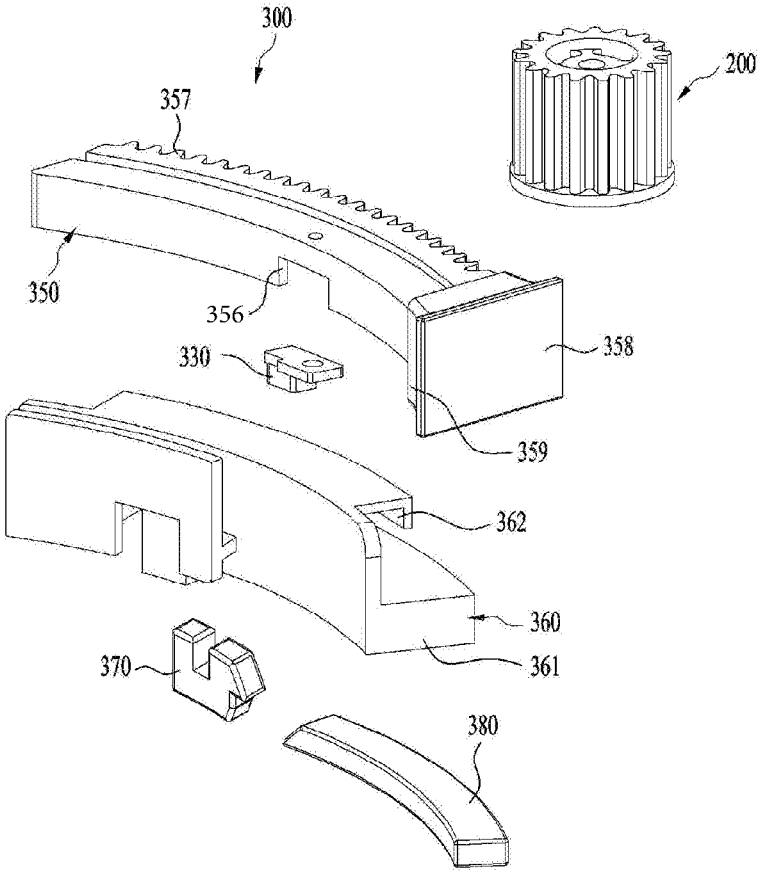

FIG. 14 is an exploded view of another example multi-stage rack of another example door opening device.

DETAILED DESCRIPTION

Hereinafter, example implementations of the present disclosure will be described in detail with reference to the accompanying drawings.

Figure 1:
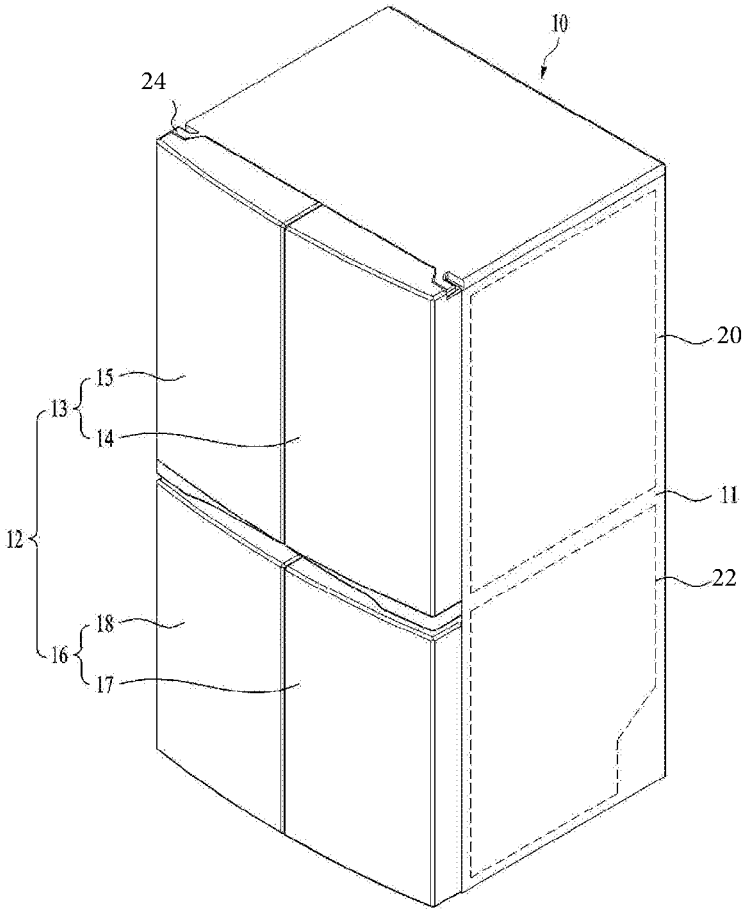
FIG. 1 is a view showing an example refrigerator.
Figure 2:
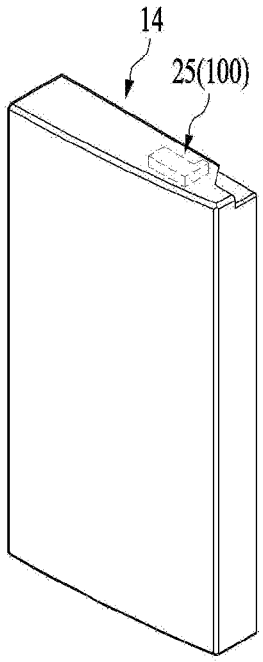
FIG. 2 is a view showing an example door of the example refrigerator.

First, the refrigerator and the door of the refrigerator shown in FIGS. 1 and 2 may be the refrigerator and the door of the refrigerator of the related art. However, these can be applicable to one implementation of the present disclosure and thus will be described first.

The example refrigerator may include two doors for opening and closing an upper refrigerating compartment and two doors for opening and closing a lower freezing compartment.

The refrigerator may further include a cabinet 10 having a storage compartment and a door 12 provided on the cabinet 10. The storage compartment formed by the cabinet may be opened and closed by the door 12. The appearance of the refrigerator may be defined by the cabinet 10 and the door 12.

A user may use the refrigerator at the front side of the refrigerator, and the door may be located at the front side of the refrigerator.

For example, a refrigerating-compartment door 13 for opening and closing a refrigerating compartment 20 may be included. The refrigerating-compartment door 13 may include left and right doors 15 and 14. In examples, a freezing-compartment door 16 for opening and closing a freezing compartment 22 may be included. The freezing-compartment door 16 may include left and right doors 18 and 17. The refrigerating compartment 20 and the freezing compartment 22 may be partitioned through a partition 11.

The door 12 may rotate through a door hinge 24. That is, the door 12 may rotate relative to a cabinet through the door hinge 24.

In general, a user grasps the door to open the door. For user convenience, the door may be automatically opened.

FIG. 2 is a perspective view showing an example of the door shown in FIG. 1. For convenience, a right refrigerating-compartment door 14 is shown.

In some implementations, the refrigerator may include a door opening device 25(100) for automatically opening the door. For example, a device for automatically opening the door using electric power may be included. The device may be provided in the door as shown in FIG. 2. In other examples, the device may be provided in the cabinet.

In some implementations, the door opening device 25(100) may be driven in a predetermined condition or state. The door is automatically opened by driving the door opening device 25(100). In some cases, force required for the user to open the door may be remarkably reduced or may not be required. In some examples, a sensor for determining the predetermined condition or state may be necessary. For example, a sensor for recognizing approach of the user may be used and input means such as a specific button or touch sensor may be used.

Figure 3:
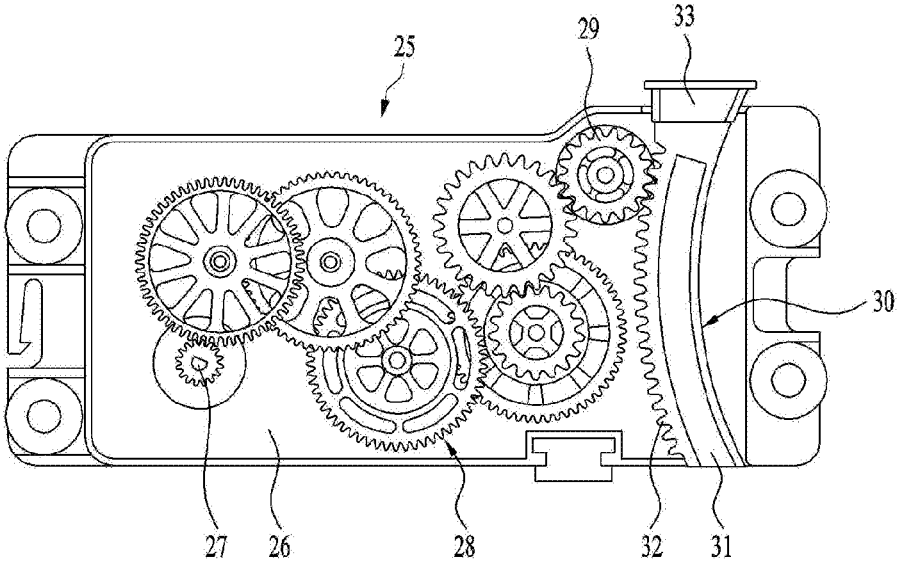
FIG. 3 is a view showing a state before an example rack is withdrawn from an example door opening device of the related art.
Figure 4:
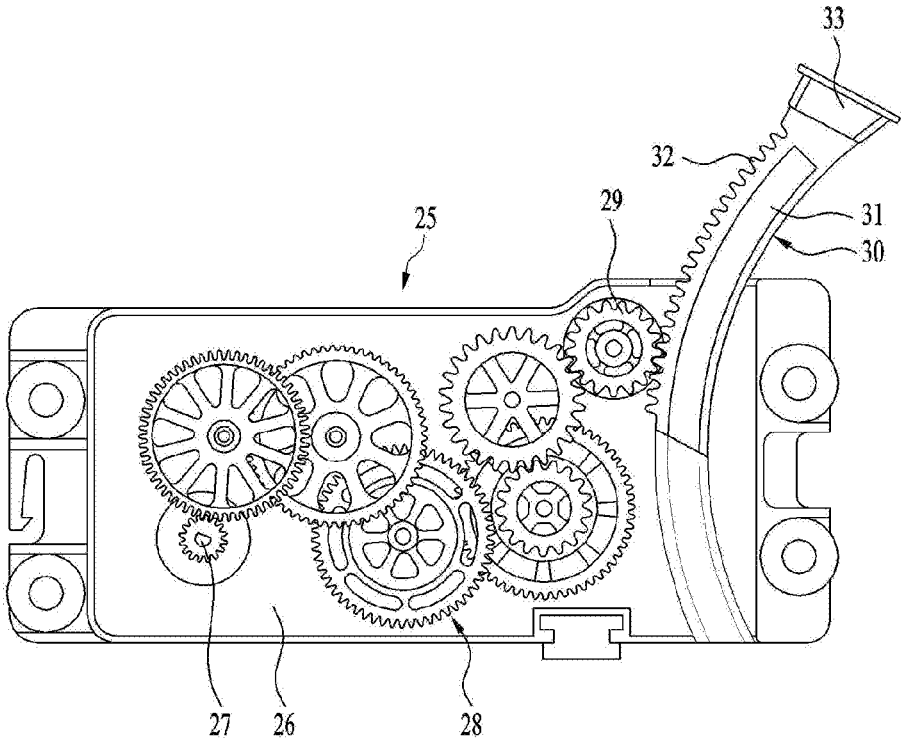
FIG. 4 is a view showing a state after the example rack is withdrawn from the example door opening device of the related art.

As described above, the present disclosure may solve the problem of the door opening device of the related art shown in FIGS. 3 and 4. For example, the present disclosure relates to the door opening device capable of efficiently increasing a door opening angle by changing the rack of the related art.

Hereinafter, the exemplary door opening device and, for example, the rack will be described in detail with reference to FIGS. 5 and 6. Some components except for the rack and a detailed description thereof may be omitted.

Figure 5:
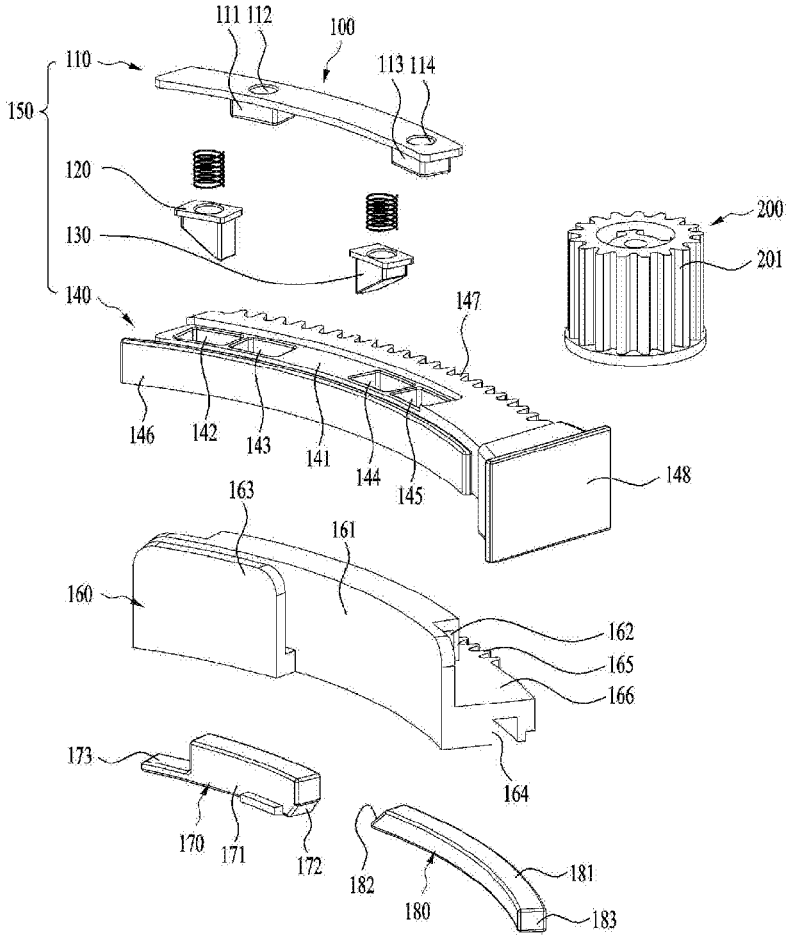
FIG. 5 is an exploded view of an example multi-stage rack of an example door opening device of the present disclosure.

The multi-stage rack 100 and the reduction gear 200 shown in FIGS. 5 and 6 may correspond to the rack 30 and the reduction gear 29 of the related art shown in FIGS. 3 and 4. The door opening device may be provided at the upper side of the cabinet, instead of the door. In this case, the rack pushes the door in order to open the door.

The rack of the door opening device may be a multi-stage rack 100 instead of a single rack. For example, the multi-stage rack including at least two racks may be formed. In some examples, the rack may be a pushing member that is configured to push the cabinet or the door.

The multi-stage rack 100 may include a first rack 150 and a second rack 160. The first rack 150 is withdrawn to push the cabinet or the door. That is, the first rack may directly apply force to the cabinet or the door. The first rack 150 may include a rack cover 148 directly contacting the cabinet or the door. The rack cover 148 may be fastened to the body 140 of the first rack through a hook structure 149 at the distal end of the first rack.

In some implementations, the first rack 150 and the second rack 160 may be stacked up or overlapped. The length of the multi-stage rack decreases as the overlapping portion of the racks increases and increases as the overlapping portion of the racks decreases.

The first rack 150 and the second rack 160 may be relatively moved. That is, the second rack 160 is moved relative to the first rack 150 or the first rack 150 may be moved relative to the second rack 160. For example, the racks may be slidably connected to each other. Movement of the first rack 150 and the second rack 160 includes withdrawal and insertion.

Since the second rack 160 may be moved relative to the first rack 150, the length of the multi-stage rack may be changed. For example, the length of the multi-stage rack may be minimized when the multi-stage rack is finally inserted and may be maximized when the length of the multi-stage rack 100 is finally withdrawn.

When the length of the multi-stage rack is minimized, the multi-stage rack 100 is maximally inserted or retracted into the housing of the door opening device. Accordingly, influence on the space where the multi-stage rack is provided is minimized. When the length of the multi-stage rack is maximized, the multi-stage rack 100 is maximally withdrawn or protruded from the housing of the door opening device. Accordingly, the withdrawal length of the multi-stage rack may be remarkably increased.

In some implementations, the second rack 160 may be provided to enable relative withdrawal of the first rack 150 and simultaneous withdrawal of the first rack 150. Here, relative withdrawal of the first rack 150 means that the second rack is not withdrawn but the first rack 150 is withdrawn, and simultaneous withdrawal of the first rack 150 means that the first rack 150 and the second rack 160 are withdrawn together, from the viewpoint of the second rack.

Accordingly, these terms may be changed from the viewpoint of the first rack but the meanings thereof may be the same. In some examples, the connection relation between the first rack 150 and the second rack 160 may be the same even upon insertion of the rack.

The multi-stage rack 100 may be provided to be withdrawn or inserted by the driving power of the motor 27. For example, the multi-stage rack may be withdrawn by normal-direction driving of the motor 27 and may be inserted by opposite-direction driving of the motor.

The reduction gear 200 may be provided to transfer the driving power of the motor 27 to the multi-stage rack 100.

In some implementations, the multi-stage rack 100 may be provided such that simultaneous withdrawal of the first rack may be performed after relative withdrawal of the first rack 150 by one-direction rotation of the reduction gear 200. That is, only the first rack 150 may be first withdrawn and then the first rack 150 and the second rack 160 may be withdrawn together. For example, the first rack 150 may slide from the second rack 160 to be withdrawn by a predetermined distance and then the first rack 150 and the second rack 160 may be withdrawn together. Here, it can be seen that the length of the multi-stage rack 100 increases by relative withdrawal of the first rack 150.

In some implementations, the multi-stage rack 100 may be provided such that simultaneous withdrawal of the first rack may be performed before relative withdrawal of the first rack 150 by one-direction rotation of the reduction gear 200. That is, the first rack 150 may be withdrawn together with the second rack 160, and then only the first rack 150 may be withdrawn relative to the second rack 160. For example, the first rack 150 and the second rack 160 may be withdrawn together, and then the first rack 150 may slide from the second rack 160 to be withdrawn by a predetermined distance.

In some implementations, the multi-stage rack 100 may be provided to perform relative withdrawal of the second rack. In these cases, the second rack may slide from the first rack to be withdrawn without moving the first rack. Here, it can be seen that the length of the multi-stage rack 100 decreases by relative withdrawal of the second rack 160.

The relative withdrawal distance of the first rack may be relatively less than the relative withdrawal distance of the second rack. Accordingly, decrease in the maximum length of the multi-stage rack by relative withdrawal of the second rack is small. In this case, allowance of relative withdrawal of the second rack may be efficient for stable gear engagement. This will be described below.

In some implementations, the multi-stage rack 100 may be provided such that relative withdrawal of the first rack 150, simultaneous withdrawal of the first rack 150, relative withdrawal of the second rack and simultaneous withdrawal of the first rack are sequentially performed by one-direction rotation of the reduction gear 200. That is, the process including the above-described steps may be performed from an initial position (e.g., a final insertion position of the multi-stage rack) to a maximum withdrawal position of the multi-stage rack.

Hereinafter, the structure of the multi-stage rack will be described in detail.

First, the first rack 150 will be described.

The first rack 150 includes the body 140. The body 140 may include a rack gear 147. The rack gear 147 may be formed in an outer surface of the body 140. In some examples, the rack gear 147 may be continuously formed from the front end to the rear end thereof in the longitudinal direction of the body 140.

The body 140 may include a rail 146. The rail 146 may be provided to support sliding of the first rack 150 relative to the second rack 160. The rail may guide sliding of the first rack 150.

The rack cover 148 is provided at the distal end of the body 140. The rack cover 148 may be formed of an elastic material such as rubber or silicon, for instance. In this case, the rack cover may be adhered to the cabinet or the door such that pushing force of the first rack 150 may be effectively transferred.

In some implementations, components for selectively connecting or disconnecting the first rack and the second rack are provided between the first rack 150 and the second rack 160. Such selective connection or disconnection may be generated upon withdrawing or inserting the multi-stage rack 100.

For selective connection between the first rack 150 and the second rack 160, a first transferring member 120 may be provided. The first transferring member 120 may be provided in the first rack 150.

The first transferring member 120 may be provided such that simultaneous withdrawal of the first rack is performed after relative withdrawal of the first rack 150. That is, the first rack 150 and the second rack 160 may be connected to be simultaneously withdrawn.

The first transferring member 120 may be provided to selectively protrude toward the second rack 160. For example, the first transferring member 120 may include a spring 125. If compression of the spring is maintained, the first rack 150 and the second rack 160 are disconnected through the first transferring member 120. When the first transferring member 120 protrudes and, for example, when compression of the spring is released, the first rack 150 and the second rack 160 may be connected through the first transferring member 120.

The first transferring member 120 may be provided in the first rack 150. For example, a first reception part 142 may be formed in the body 140. The first transferring member 120 may be received in the first reception part 142 to selectively protrude toward the second rack 160. For example, the first transferring member 120 may be vertically moved.

The first reception part 142 may penetrate through the body 140. In this case, when the first transferring member 120 further protrudes from the first reception part 142, the first rack 150 and the second rack 160 may be connected.

In some implementations, for selective connection between the first rack 150 and the second rack 160, a second transferring member 130 may be provided. The second transferring member 130 may be provided in the first rack 150.

The second transferring member 130 may be provided such that simultaneous insertion of the first rack is performed after relative insertion of the first rack 150. That is, the first rack 150 and the second rack 160 may be connected to be simultaneously inserted.

The second transferring member 130 may be provided to selectively protrude toward the second rack 160. To this end, the second transferring member 130 may include a spring 125. If compression of the spring is maintained, the first rack 150 and the second rack 160 are disconnected through the second transferring member 130. If the second transferring member 130 protrudes, that is, if compression of the spring is released, the first rack 150 and the second rack 160 may be connected through the second transferring member 130.

The second transferring member 130 may be provided in the first rack 150. To this end, a second reception part 144 may be formed in the body 140. The second transferring member 130 may be received in the second reception part 144 to selectively protrude toward the second rack 160. For example, the second transferring member 130 may be vertically moved.

The second reception part 144 may penetrate through the body 140. Accordingly, if the second transferring member 130 further protrudes from the second reception part 144, the first rack 150 and the second rack 160 may be connected.

In some implementations, a body cover 110 may be provided to movably fix the first transferring member 120 and the second transferring member 130 to the body 140. The body cover 110 may be provided to cover the first reception part 142 and the second reception part 144.

In order to stably fasten the body cover 110 to the body 140, bosses 111 and 113 are formed on the body cover. Fastening grooves 143 and 145 are formed in the body in correspondence with the bosses 111 and 113. The bosses 111 and 113 may be inserted into the fastening grooves 143 and 145 and then may be screwed through fastening holes 112 and 114 formed in the body cover 110.

A body cover seating part 141 may be formed in the body cover such that the body cover 110 is stably fastened to the body 140.

The second rack 160 may be provided below the first rack 150. The second rack includes a body 161 and a rack gear 165 formed in the body. The rack gear 165 may be provided to be engaged with the gear teeth 201 of the reduction gear 200.

A seating part 166, in which the first rack 150 is seated, may be formed in the body 161 of the second rack 160. The first rack 150 may slide on the seating part 166 of the second rack 160.

A rail reception part 162 connected to the rail 146 of the first rack 150 may be formed in the second rack 160. The rail 146 may be connected to the rail reception part 162 to guide and support sliding of the second rack.

In some implementations, the second rack 160 may be supported to slide relative to the housing 26. Accordingly, a rail 163 for guiding and supporting sliding of the second rack relative to the housing 26 may be formed.

A channel 164 may be formed in the second rack 160. The channel 164 may be formed to penetrate through the center of the body 161 in the longitudinal direction. The channel 164 is opened at the lower side of the body 140. A third transferring member 170 and a guide member 180 may be inserted into the channel 164.

The guide member 180 may be provided to be fixed to the housing. Accordingly, the second rack 160 may be slidably moved along the guide member 180.

The third transferring member may be provided to be withdrawn or inserted along with the second rack. The third transferring member may be selectively vertically moved.

In some implementations, a first penetration part 167 and a second penetration part 168 may be formed in the seating part 166 of the second rack. The third transferring member 170 provided in the second rack 160 penetrates through the first penetration part and the first transferring member 120 and the second transferring member 130 provided in the first rack 150 penetrate through the second penetration part. The first penetration part and the second penetration part are not shown in FIGS. 5 and 6 and thus will be described below.

The guide member 180 is provided to elevate and drop the third transferring member 170. As the third transferring member 170 is moved along with the second rack 160, the third transferring member 170 is elevated along the fixed guide member 180. When the third transferring member is moved in the opposite direction, the third transferring member 170 is dropped.

In some implementations, an upwardly inclined surface 172 may be formed in the front end of the third transferring member 170 in a withdrawal direction. An upwardly inclined surface 182 may be formed in the rear end of the guide member 180 in the withdrawal direction. The inclined surface 172 of the third transferring member may go up along the inclined surface 182 of the guide member 180. The third transferring member is elevated to protrude upward through the first penetration part. For example, the projection 171 of the third transferring member protrudes through the first penetration part 167. At this time, the third transferring member may be provided to push the rear end of the first rack 150. In some cases, the first rack and the second rack are connected by the third transferring member 170 in the withdrawal direction of the second rack 160.

In some implementations, a stopper 173 may be formed on the third transferring member 170. The stopper 173 may be provided to contact the periphery of the first penetration part. Accordingly, when the third transferring member 170 is elevated, the stopper 173 is elevated to contact the periphery of the first penetration part 167. In some cases, the stopper 173 is no longer elevated. In some examples, through the stopper, the third transferring member may be prevented from escaping through the first penetration part.

The other end of the guide member 180 is locked to the rack cover 148 to perform a stopper function. That is, the first rack may be locked to the other end of the guide member 180 to be prevented from being further moved toward the second rack in the insertion direction.

Hereinafter, the withdrawal mechanism of the multi-stage rack 100 will be described with reference to FIGS. 7 to 11. FIGS. 7 to 11 show the cross-section taken along line A-A' of FIG. 6.

Figure 7:
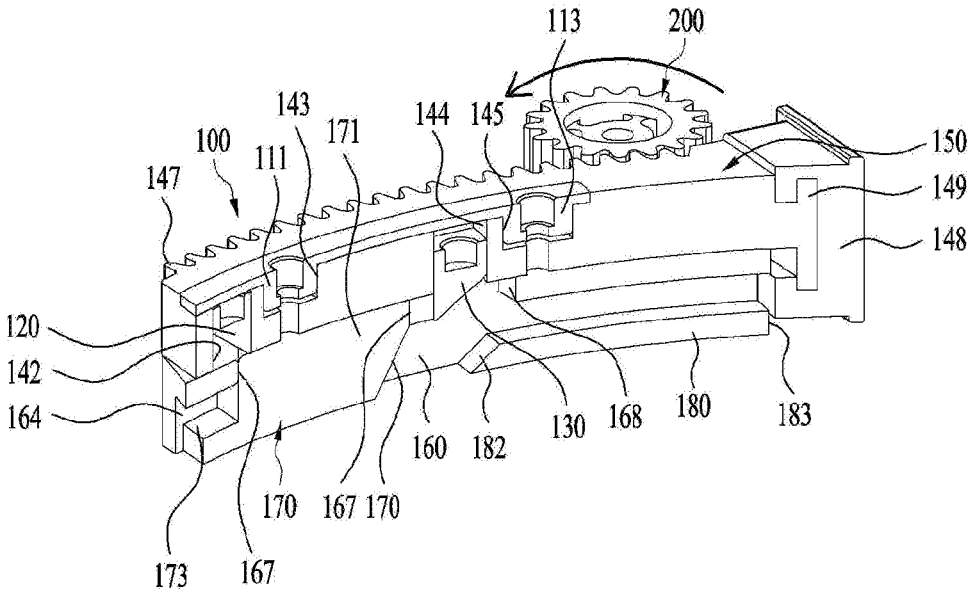
FIG. 7 is a cross-sectional view taken along line A-A' of FIG. 6 showing the multi-stage rack starting to be withdrawn.

As shown in FIG. 7, the motor may be driven to rotate the reduction gear 200 in a state in which the multi-stage rack 100 is finally inserted (at the initial position or the initial state). For example, the multi-stage rack 100 may start to be withdrawn by counter-clockwise rotation of the reduction gear 200. At this time, the first transferring member 120 is elevated, the second transferring member 130 is dropped, and the third transferring member 170 is dropped. The second transferring member 130 is dropped to be inserted into the second penetration part 168.

As the reduction gear 200 rotates in the counter-clockwise direction, relative withdrawal of the first rack is performed. That is, the gear teeth 201 of the reduction gear 200 are engaged with the rack gear 147 of the first rack such that only the first rack is withdrawn. The second transferring member 130 is elevated to escape from the second penetration part 168.

The distal end or the lower end of the second transferring member 130 is inclined upward in the withdrawal direction. In this case, the second transferring member may be easily elevated by the inclined surface to escape from the second penetration part.

Figure 8:
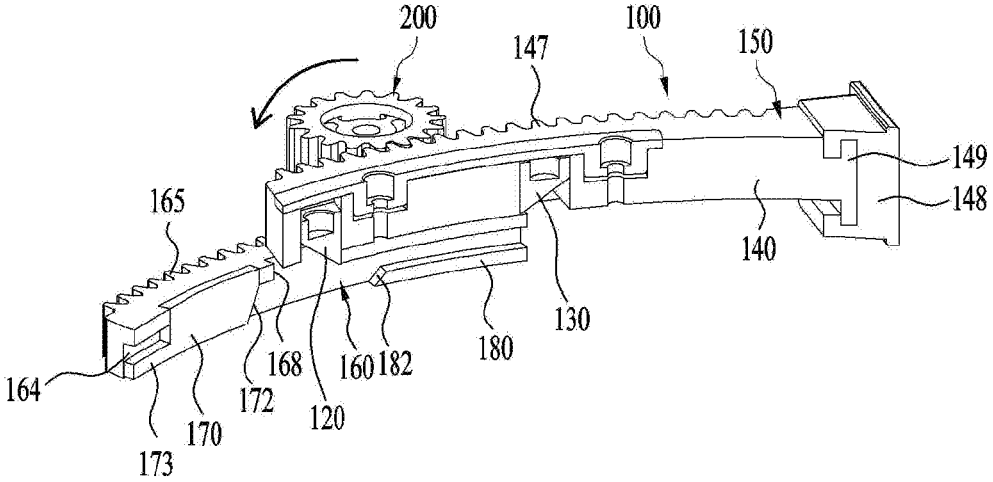
FIG. 8 is a cross-sectional view taken along line A-A' of FIG. 6 showing an example relative withdrawal of an example first rack.

When the first rack is withdrawn by a predetermined length, as shown in FIG. 8, the first transferring member 120 operates to connect the first rack and the second rack. That is, the first transferring member 120 is dropped to be inserted into and locked to the second penetration part 168.

The shape of the distal end or the lower end of the first transferring member 120 is opposite to that of the second transferring member. For example, the distal end or the lower end of the first transferring member 120 may be inclined downward in the withdrawal direction. In this case, when the first rack 150 is withdrawn, the vertical surface of the first transferring member 120 is locked to the second penetration part 168. Therefore, the first rack and the second rack are connected in the withdrawal direction.

If the first rack and the second rack are connected through the first transferring member 120, the first rack and the second rack are withdrawn together when the reduction gear 200 rotates in the counter-clockwise direction. That is, simultaneous withdrawal of the first rack is performed.

Figure 9:
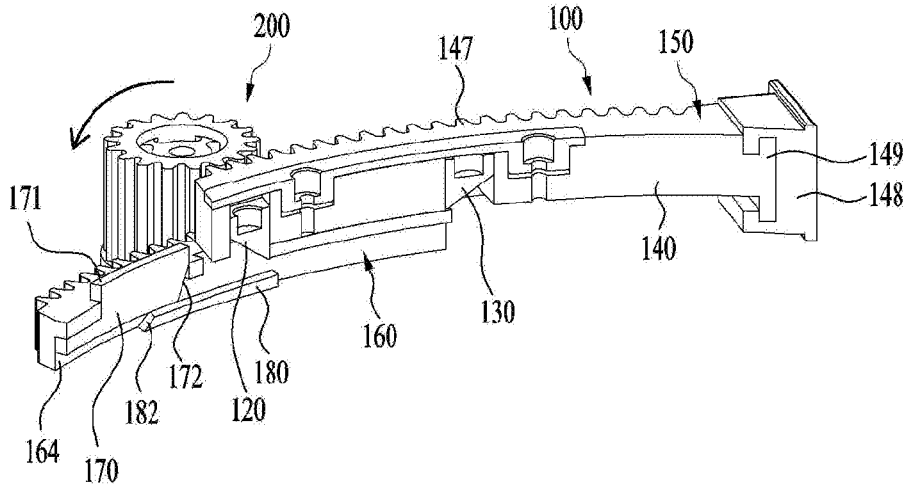

When the first rack and the second rack are simultaneously withdrawn by a predetermined length, as shown in FIG. 9, engagement between the first rack and the reduction gear is released and the third transferring member 170 goes up the guide member 180 to protrude. The first rack is not withdrawn but only the second rack is withdrawn by a predetermined length. That is, relative withdrawal of the second rack is performed.

Here, during relative withdrawal of the second rack, force applied to the door through the multi-stage rack may be broken, reduced, or briefly disappeared. For example, force applied to the door is broken during a period when one to three reduction gears rotate, which is referred to as a break time or break period. This means that force is not applied to the first rack 150 in the break time or the break period. If force is applied to the first rack during the predetermined period, large load may be applied to the distal end of the first rack. Therefore, the reduction gear and the rack gear of the first rack (e.g., the rack gear of the distal end) may be damaged.

After relative withdrawal of the second rack or after the break period, the reduction gear is engaged with the rack gear 165 of the second rack to withdraw the second rack. At this time, as shown in FIG. 10, the elevated third transferring member is connected to the distal end of the first rack. In this case, the second rack pushes the first rack such that the first and second rack are withdrawn. Simultaneous withdrawal of the first rack is performed until final withdrawal of the multi-stage rack.

As shown in FIG. 11, when the multi-stage rack is finally withdrawn, rotation of the reduction gear is stopped. When the multi-stage rack is finally withdrawn, the length of the multi-stage rack may be maximized.

Hereinafter, the insertion mechanism of the multi-stage rack will be described in detail with reference to FIGS. 11 to 13.

As shown in FIG. 11, after the multi-stage rack is finally withdrawn, movement of the multi-stage rack is stopped. If a predetermined time, for example, 1 to 2 seconds, has passed, the motor is driven to rotate the reduction gear in the reverse direction, for example, the clockwise direction, to insert the multi-stage rack.

Upon initial insertion of the multi-stage rack, the reduction gear is engaged with the rack gear 165 of the second rack 160 to insert the second rack. Since force applied to the first rack is removed, the first rack is inserted along with the second rack. That is, simultaneous insertion of the first rack is performed.

As the reduction gear continuously rotates, engagement between the reduction gear 200 and the rack gear 165 of the second rack is released and the third transferring member is dropped while separating from the guide member 180. That is, the third transferring member is inserted into the first penetration part 167. The reduction gear is engaged with the rack gear 147 of the first rack. That is, relative insertion of the first rack is performed in the state shown in FIG. 12.

Upon inserting the multi-stage rack, unlike withdrawal of the multi-stage rack, relative insertion of the second rack or the break period is not generated, because an object (that is, the door or the cabinet) pushed by the multi-stage rack is removed upon inserting the multi-stage rack.

As relative insertion of the first rack is performed, the first transferring member 120 is elevated and the second transferring member 130 is dropped. The dropped second transferring member 130 is locked to the second penetration part 168. In this case, as the first rack is inserted, the second transferring member 130 inserts the second rack. That is, simultaneous insertion of the first rack is performed.

Upon simultaneous insertion of the first rack, the length of the multi-stage rack may be minimized. The multi-stage rack is further inserted in a state in which the length of the multi-stage rack is minimized to reach a final insertion state as shown in FIG. 13.

For example, the state of the multi-stage rack at the withdrawal start position of FIG. 7 and the state of the multi-stage rack at the insertion end position of FIG. 13 are equal to each other.

Hereinafter, another example multi-stage rack 300 will be described with reference to FIG. 14.

The multi-stage rack 300 is basically similar to the above-described multi-stage rack 100, but differs therefrom in which the second transferring member 130 is omitted.

The second transferring member 130 may connect the first rack and the second rack to perform simultaneous insertion of the first rack upon inserting the multi-stage rack. In some implementations, the second transferring member 130 is omitted.

In some implementations, the function of the second transferring member 130 may be performed by a rack cover 358. A protrusion surface 359 may be formed on the rear end of the rack cover 358. The protrusion surface 359 may be provided to contact the front end 361 of the second rack 360. While the first rack 350 is inserted, the protrusion surface 359 and the front end 361 are connected to insert the first rack and the second rack. In this case, simultaneous insertion of the first rack may be performed.

By omitting the second transferring member 130, the detailed structure of the first rack 350 may be changed and the shape of the first transferring member 330 may be changed. In some examples, a mounting slot 356 may be formed in another shape in order to mount the first transferring member 330 therein.

In some implementations, a rack gear 357 may be formed in the first rack 350 and the structure supporting sliding of the first rack and the second rack may be practically the same.

Although the shape of the second rack may be changed, the basic mechanism may be the same.

The guide member 380 is equally or similarly provided and the shape of the third transferring member 370 may be changed.

In some examples, the multi-stage rack 300 having a simpler structure may be provided by omitting the second transferring member.

In some implementations, the multi-stage rack is driven through a single reduction gear or a connection gear. The multi-stage rack may include the first rack and the second rack and these racks may be vertically located. Each rack may include a rack gear formed therein. The reduction gear may be formed to correspond to the upper and lower rack gears. That is, the single reduction gear may have a height enabling simultaneous engagement with the upper and lower rack gears.

In some implementations, it may be possible to provide a refrigerator capable of changing the length of a rack for opening a door.

In some implementations, it may be possible to provide a refrigerator capable of overcoming limitation in a space where a rack for opening a door is mounted, by decreasing the length of the rack upon insertion and increasing the length of the rack upon withdrawal.

In some implementations, it may be possible to provide a refrigerator capable of easily increasing an opening angle of a door.

In some implementations, it may be possible to provide a refrigerator capable of changing the length of a rack by a mechanical mechanism upon driving a motor.

In some implementations, it may be possible to provide a refrigerator capable of preventing a first rack from being damaged and improving reliability by providing a break period in which driving power of a motor is not applied to the first rack to push a door.

What is claimed is:

1. A refrigerator comprising:

a cabinet defining a storage compartment;

a door configured to open and close the storage compartment; and a door opening device configured to open the door, the door opening device including a motor, a pushing member configured to be driven by the motor to thereby open the door, and a reduction gear configured to transfer driving power of the motor to the pushing member, wherein the pushing member comprises:

a first rack configured to be driven by the motor, the first rack being configured to push one of the cabinet or the door and comprising a first rack gear arranged along a longitudinal direction of the first rack, a second rack that is configured to be driven by the motor and slidably coupled to the first rack and that is configured to overlap with the first rack, the second rack comprising (i) a first portion that has a second rack gear defined on an outer surface facing the reduction gear and arranged along a longitudinal direction of the second rack and (ii) a second portion that extends from an end of the first portion along the longitudinal direction of the second rack and that has no rack gear on the outer surface of the second rack, wherein the first portion and the second portion of the second rack face the first rack gear, and a transferring member received in the first rack and configured to selectively protrude toward and retract from the second rack to thereby restrict or allow relative movement between the first rack and the second rack, wherein the motor is configured to:

in a state in which the door is closed, rotate in a first direction to cause the pushing member to move from an initial position to a door opening position to thereby open the door, and after the door is opened, rotate in a second direction opposite to the first direction to cause the pushing member to move from the door opening position to the initial position, and wherein the reduction gear is configured to, in a state in which the pushing member is located at the initial position, engage with the first rack gear and face the second portion of the second rack.

2. The refrigerator of claim 1, wherein a portion of the second rack that overlaps with the first rack varies based on the first rack moving relative to the second rack.

3. The refrigerator of claim 1, wherein the reduction gear is configured, based on moving the first rack together with the second rack, to engagingly contact both the first rack and the second rack.

4. The refrigerator of claim 1, wherein the reduction gear is configured, based on moving the first rack together with the second rack, to engagingly contact the second rack without engagingly contacting the first rack.

5. The refrigerator of claim 1, wherein the second rack gear is arranged at a rear portion of the second rack and configured to align with the first rack gear based on the first rack overlapping with the second rack.

6. The refrigerator of claim 5, wherein the second rack gear is located vertically below the first rack gear, and wherein the reduction gear has a height that enables engagement with both of the first and second rack gears.

7. The refrigerator of claim 1, wherein the pushing member is configured to open the door to a first angle based on the first rack being driven by the motor, and wherein the pushing member is configured to open the door to a second angle greater than the first angle based on the second rack being driven by the motor.

8. The refrigerator of claim 7, wherein the first rack is configured to move relative to the second rack based on the first rack being driven by the motor, and wherein the first rack is configured to move together with the second rack based on the second rack being driven by the motor.

9. The refrigerator of claim 7, wherein the first rack is configured to be withdrawn by a first predetermined distance relative to the second rack, wherein the first rack is configured to move together with the second rack based on the first rack being withdrawn by the first predetermined distance relative to the second rack, wherein the second rack is configured to be withdrawn by a second predetermined distance relative to the first rack based on the first rack moving together with the second rack, and wherein the first rack is configured to move together with the second rack based on the second rack being withdrawn by the second predetermined distance relative to the first rack.

10. The refrigerator of claim 7, wherein the first rack is configured to be withdrawn by a predetermined distance relative to the second rack, and wherein the first rack is configured to move together with the second rack based on the first rack being withdrawn by the predetermined distance relative to the second rack.

11. The refrigerator of claim 1, wherein the transferring member includes:

a first transferring member configured to restrict relative movement between the first rack and the second rack in the first direction; and a second transferring member configured to restrict relative movement between the first rack and the second rack in a second direction opposite the first direction.

12. The refrigerator of claim 1, wherein the first rack includes a body, the body having:

an outer surface that defines the first rack gear, and an upper surface that defines a reception opening configured to receive the transferring member, the reception opening extending through the body.

13. The refrigerator of claim 12, wherein the transferring member has an inclined surface that is inclined with respect to the longitudinal direction of the second rack and that is configured to contact the second rack based on moving from the first rack to the second rack.

14. A refrigerator comprising:

a cabinet defining a storage compartment;

a door configured to open and close the storage compartment; and a door opening device configured to open the door, the door opening device including a motor, a pushing member configured to be driven by the motor to open the door, and a reduction gear configured to transfer driving power of the motor to the pushing member, wherein the pushing member comprises:

a first rack configured to be withdrawn in a first direction, the first rack comprising a first rack gear arranged along a longitudinal direction of the first rack, a second rack relative to which the first rack is configured to be withdrawn by a predetermined distance in the first direction, the second rack comprising (i) a first portion that has a second rack gear defined on an outer surface facing the reduction gear and arranged along a longitudinal direction of the second rack and (ii) a second portion that extends from an end of the first portion along the longitudinal direction of the second rack and that has no rack gear on the outer surface of the second rack, wherein the first portion and the second portion of the second rack face the first rack gear, and a transferring member received in the first track and configured to, based on the first rack being withdrawn by the predetermined distance relative to the second rack, protrude toward the second rack to thereby couple the first rack to the second rack and restrict relative movement between the first rack and the second rack, wherein the motor is configured to, in a state in which the door is closed, rotate to cause the pushing member to move from an initial position to a door opening position to thereby open the door, and wherein the reduction gear is configured to:

in a state in which the pushing member is located at the initial position, engage with the first rack gear and face the second portion of the second rack to allow the first rack to move relative to the second rack and open the door to a first angle, and in a state in which the first rack is coupled to the second rack, engage with the first rack gear and the second rack gear to allow the first rack and the second rack to move together and open the door to a second angle greater than the first angle.

15. The refrigerator of claim 14, wherein the first rack is configured to be withdrawn to a final position to open the door to the second angle based on having moved together with the second rack.

16. The refrigerator of claim 15, wherein the first rack is configured to retract from the final position together with the second rack in a second direction opposite the first direction based on the second rack gear being engaged with the reduction gear.

17. The refrigerator of claim 16, wherein the first rack is configured, based on the first rack having retracted together with the second rack in the second direction, to retract relative to the second rack in the second direction based on the first rack gear being engaged with the reduction gear.

18. A refrigerator comprising:

a cabinet defining a storage compartment;

a door configured to open and close the storage compartment; and a door opening device configured to open the door, the door opening device including a motor, a pushing member driven configured to be driven by the motor to open the door, and a reduction gear configured to transfer driving power of the motor to the pushing member, wherein the pushing member includes:

a first rack configured to be withdrawn in a first direction, the first rack comprising a first rack gear arranged along a longitudinal direction of the first rack, a second rack relative to which the first rack is configured to be withdrawn by a predetermined distance in the first direction, the second rack comprising (i) a first portion that has a second rack gear defined on an outer surface facing the reduction gear and arranged along a longitudinal direction of the second rack and (ii) a second portion that extends from an end of the first portion along the longitudinal direction of the second rack and that has no rack gear on the outer surface of the second rack, wherein the first portion and the second portion of the second rack face the first rack gear, and a transferring member received in the first rack and configured to, based on the first rack being withdrawn by the predetermined distance relative to the second rack, protrude to the second rack to thereby couple the first rack to the second rack and restrict relative movement between the first rack and the second rack, wherein the motor is configured to, in a state in which the door is closed, rotate to cause the pushing member to move from an initial position to a door opening position to thereby open the door, and wherein the reduction gear is configured to:

in a state in which the pushing member is located at the initial position, engage with the first rack gear and face the second portion of the second rack to allow the first rack to move relative to the second rack and open the door to a first angle, and in a state in which the first rack is coupled to the second rack, engage with the second rack gear without engaging with the first rack gear to allow the first rack and the second rack to move together and open the door to a second angle greater than the first angle.

* * * * *